United States Patent [19]

Weiner

[11] Patent Number: 4,927,148

[45] Date of Patent: May 22, 1990

[54] LOTTERY KIT

[76] Inventor: Steven L. Weiner, 5333 Blackhawk Dr., Danville, Calif. 94526

[21] Appl. No.: 202,950

[22] Filed: Jun. 6, 1988

[51] Int. Cl.[5] ..... A63F 9/00

[52] U.S. Cl. ..... 273/148 R; 206/315.1; 206/579; 220/339; 220/400

[58] Field of Search ..... 273/139, 148 R; 206/315.1, 579, 371; 220/22, 337, 339, 400

[56] References Cited

U.S. PATENT DOCUMENTS

| | | | |
|---|---|---|---|
| 239,274 | 3/1881 | Schadowsky | 206/371 X |
| 3,327,841 | 6/1967 | Schurman et al. | 220/339 X |
| 3,871,519 | 3/1975 | Groomes | 206/579 |
| 3,923,152 | 12/1975 | Minneman | 220/339 X |
| 4,098,430 | 7/1978 | Mattheis et al. | 220/339 |
| 4,635,797 | 1/1987 | Bankier | 220/339 X |
| 4,681,223 | 7/1987 | Roberts | 220/339 X |

*Primary Examiner*—Anton O. Oechsle
*Attorney, Agent, or Firm*—Townsend and Townsend

[57] ABSTRACT

A kit for lottery playing paraphernalia having a pair of rectangular members formed for positioning face-to-face to provide an openable folio case adapted for containing equipment for playing a lottery, an integral hinge joining the rectangular members along one side so they are swingable between a closed position and an open position, the confronting faces of the rectangular members being provided with a plurality of identations sized to receive and contain stacks of rectangular papers and other objects used in playing the lottery, with latch means on the rectangular members being provided for releasably holding the latter in their closed position. Changeable protective snap-on covers are provided for the rectangular members.

15 Claims, 2 Drawing Sheets

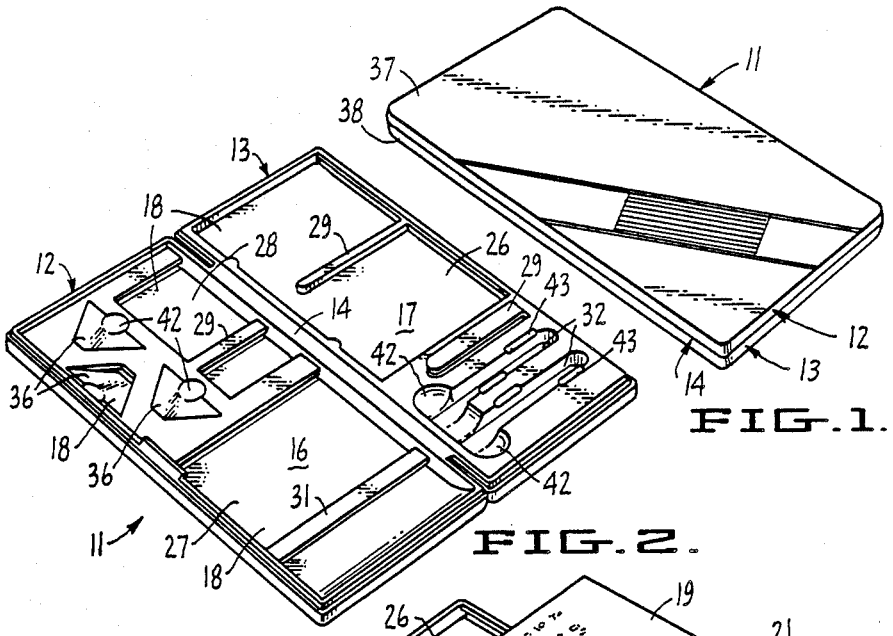
FIG. 1.
FIG. 2.
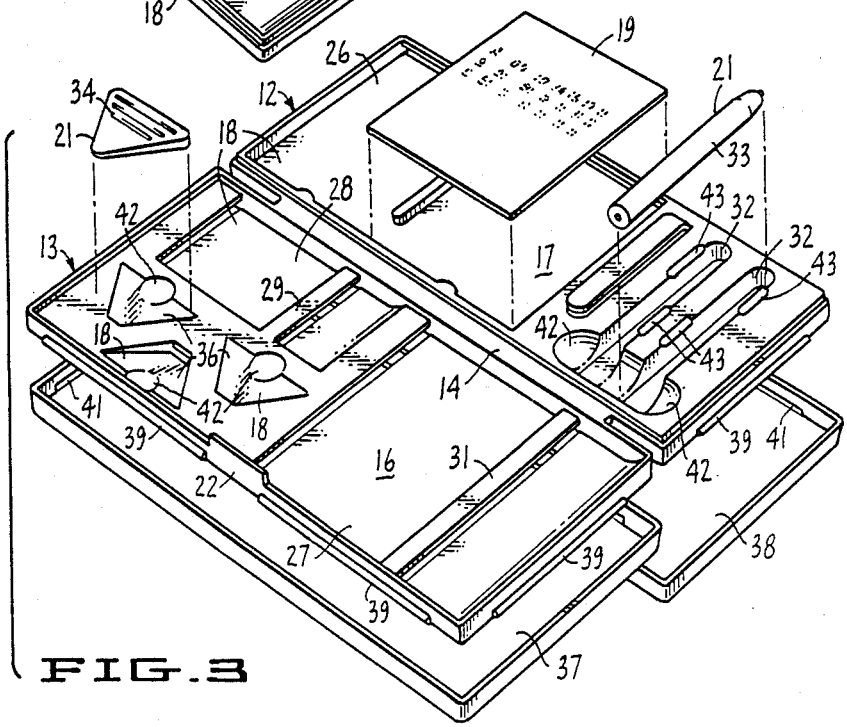
FIG. 3

LOTTERY KIT

BACKGROUND OF THE INVENTION

1. Field of the Invention

This invention relates to a lottery kit, and more particularly to a kit for carrying and storing lottery playing paraphernalia.

2. Description of the Prior Art

Ever since lotteries based on the "Lotto" type of game became legal and state-sponsored in many parts of the country, there has been an enormous demand for a device or kit capable of storing and protecting lottery tickets and other lottery playing paraphernalia in a compact, protected unit capable of being carried in the pocket of the user. A number of devices for selecting or checking lottery numbers have been proposed, but these devices have not been capable of storing lottery tickets and other paraphernalia such as marking pens and scratchers capable of removing a masking layer of latex from a lottery ticket.

A lottery number selection device and wagering kit is proposed in U.S. Pat. No. 4,721,309. The number selecting device comprises a base on which concentric circles of numbers are displayed together with a rotatable disk perforated with windows. Numbers are obtained by rotating disk to a chosen reference point on the base, selecting a particular design and color, and observing the numbers displayed within the windows and within the design color decided upon. This device is in the form of a folio kit which incorporates envelopes and file pockets for containing lottery tickets and cards. The folio kit consists of two flat members hinged together and no mention is made of forming or shaping the hinged members, or of the character of material from which the folio kit is made.

Other patents showing various number checking and selecting devices are listed as follows:

| Patent No. | Inventor | |
|---|---|---|
| 4,600,198 | D. Fox | |
| 4,603,884 | D. Burton | |
| 4,607,845 | W. Gallo | |
| 567,307 (CH) | G. Battig | September 30, 1975 |

The above-listed patents are believed to be relevant to the present invention because they were adduced by a prior art search made by an independent searcher, and a copy of each of the above-listed patents is supplied to the Patent and Trademark Office herewith.

(The term "prior art" as used herein or in any statement made by or on behalf of the applicant means only that any document or thing referred to as prior art bears, directly or inferentially, a date which is earlier than the effective date of this application. No representation nor admission is made that any of the above-listed documents is part of the prior art in any acceptation of that term, or that no more pertinent information exists.)

SUMMARY OF THE INVENTION

The present invention provides a kit for storing and carrying lottery playing paraphernalia while protecting same against tearing, loss, breaking, or the like. This is accomplished by providing a clamshell case having a pair of generally flattened commensurate rectangular members formed for positioning face-to-face to provide a folio case capable of holding and protecting papers, markers, scratchers and other equipment for playing a lottery. A hinge joins the rectangular members along one side so that the members are swingable between a closed position, like a closed clamshell, with the members face-to-face and an open position with these faces in substantial coplanar alignment.

The described faces are provided with a plurality of indentations sized to receive and contain piles or tablets of rectangular papers, and other objects such as markers and scratchers, used in playing the lottery. The rectangular members are provided with latch means on their sides opposite to the hinge, these latch members being formed for interengagement and releasable holding of the rectangular members in face-to-face closed position.

The indentations in the confronting faces of the rectangular members are dimensioned and formed for nestingly receiving one or more marking devices, such as marking pens or grease pencils, rectangular piles or pads of papers or cards used for playing the lottery game, and one or more scratching devices formed to facilitate easy removal of an overlying latex coating to reveal the numbers imprinted upon an underlying scratch card.

The rectangular members and the joining hinge are formed integrally of stiffly resilient material having a thinned section between the rectangular members providing the described hinge. Preferably, the rectangular members and integral hinge are molded of polypropylene plastic. While it is evident other molded plastic materials may be used, it should be noted that whatever material is used it should be stiff enough to protect the contents against being bent or broken and resilient enough to provide a longwearing hinge to avoid breaking of the members if the device is dropped, stepped upon or sat upon.

It is therefore a principal object of the present invention to provide a kit for lottery playing paraphernalia which is capable of receiving, carrying and protecting such paraphernalia against bending or breaking in a compact kit well adapted to be carried about in the pocket of the user.

Another object of the present invention is to provide a kit for lottery playing paraphernalia of the character described in which the paraphernalia is received within a clamshell case of stiffly resilient material of integral construction not requiring separate parts or fastenings.

A further object of the present invention is to provide a kit for lottery playing paraphernalia of the character set forth in which the inner faces of the clamshell case are provided with plural indentations sized and shaped to received and contain piles and pads of rectangular papers and cards and marking devices and scratching devices all used in playing the lottery.

Other objects and features of advantage will become apparent as the specification progresses and from the claims.

BRIEF DESCRIPTION OF THE DRAWINGS

FIG. 1 is a perspective view of a kit for lottery playing paraphernalia constructed in accordance with the present invention.

FIG. 2 is a perspective view of the kit of FIG. 1 in its open position.

FIG. 3 is a perspective view of a modified form of the invention with the parts shown in exploded relationship.

Figure 4:
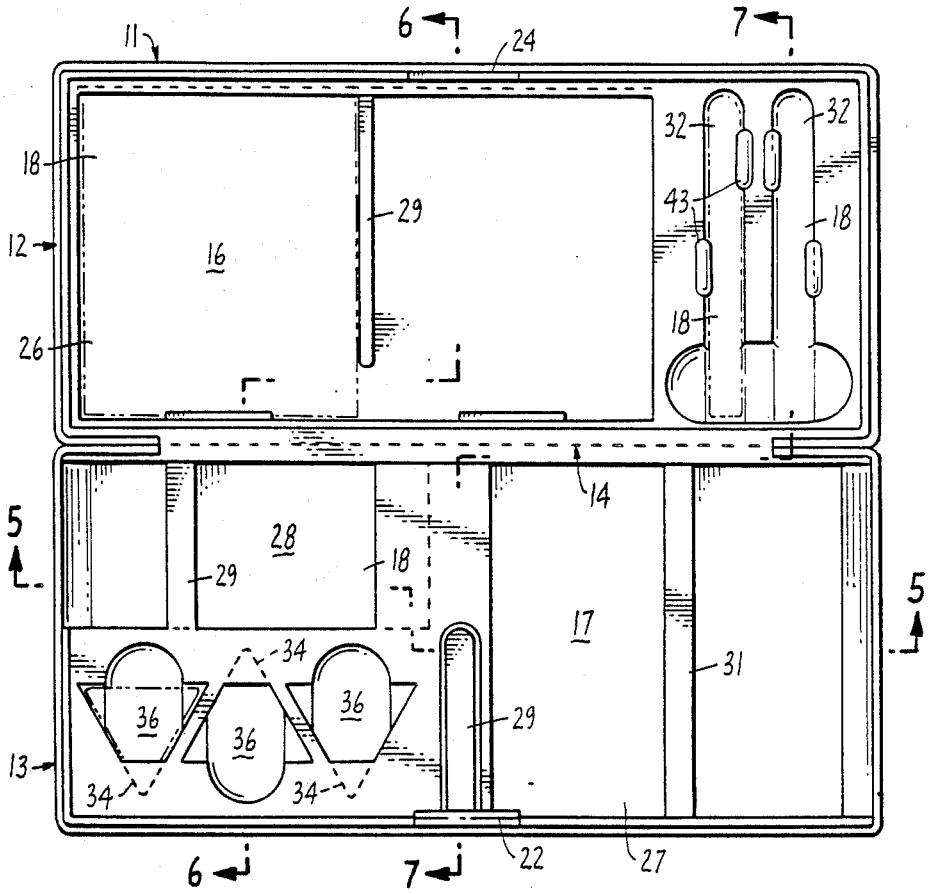
FIG. 4 is a plan view of a further modified form of the invention in open condition.
Figure 5:
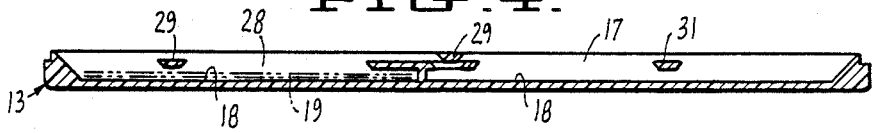
FIG. 5 is a cross-sectional view taken substantially on the plan of Line 5—5 of FIG. 4.
Figure 6:
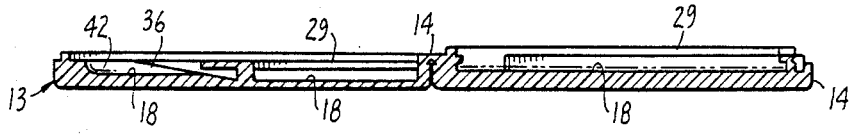
FIG. 6 is a cross-sectional view taken substantially on the plane of Line 6—6 of FIG. 4.
Figure 7:
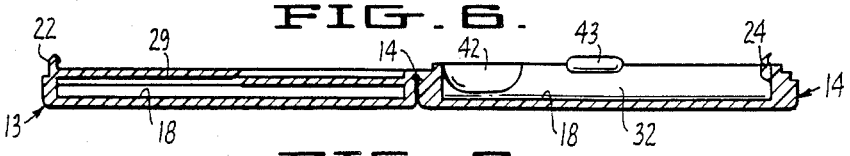
FIG. 7 is a cross-sectional view taken substantially on the plane on Line 7—7 of FIG. 4.

While only the preferred forms of the invention are illustrated in the drawings, it will be apparent that various modifications could be made without departing from the ambit of the claims.

DESCRIPTION OF THE PREFERRED EMBODIMENTS

As may be seen in the accompanying drawings, the kit for lottery playing paraphernalia of the present invention provides a clamshell case 11 having a pair of generally flattened and commensurate rectangular members 12 and 13 formed for positioning face-to-face to provide a folio case adapted for containing equipment for playing a lottery, a hinge 14 joining the rectangular members 11 and 12 along one side so that these members are swingable between a closed position with the members 12 and 13 face-to-face and an open position with the faces 16 and 17 aligned in substantially coplanar relation, the faces 16 and 17 being provided with a plurality of indentations 18 sized to receive and contain piles or pads 19 of rectangular papers, and other objects 21, used in playing the lottery, and latch means 22 on the rectangular members 12 and 13 formed for releasably holding same in closed position.

Preferably, the members 12 and 13 are formed of stiffly resilient material having an integral thinned section between the rectangular members to provide the hinge 14. The material used is preferably a moldable plastic capable of being bent back and forth along the hinge 14 a great number of times without parting. It has been found that injection molded polypropylene plastic possesses the desired properties.

The latch means 22 here comprises a latching member 23 integrally formed with one of the rectangular members 12 on the side thereof opposite to the hinge 14, and a latch engaging member 24 integrally formed with the resilient member 13 on the side thereof opposite to the hinge 14 and in confronting relation to the latching member 23. With this structure, the members 12 and 13 can easily be swung between open and closed positions about the hinge 14 and the latching member 23 and latch engaging member 24 are formed with interengaging shoulders capable of releasably holding the members 12 and 13 in closed, face-to-face position.

In accordance with the present invention, the indentations 18 in the faces 16 and 17 of the members 12 and 13 are formed to receive and hold a variety of items used in playing lottery games. Rectangular indentations 26, 27 and 28 are formed and dimensioned to receive stacks of rectangular papers or cards such as tickets upon which are recorded lottery picks, scratch-off tickets, number comparison devices, and recording pads. The exact size and shape of the rectangular indentations is governed by the size of the rectangular paper materials to be accomodated. Overlying bars or clip fingers 29 and 31 may be provided for retaining the paper materials in the rectangular indentations against accidental dislodgement, or the indentations may be formed as partially open pockets.

Elongated trough-like indentations 32 are formed in the faces 16, 17 of members 12 and 13 and are adapted for nestingly receiving an elongated marking device such as a felt pen or grease pencil 33.

As a feature of the invention, flat, triangular scratching devices 34 are removably mounted in corresponding indentations 36. Many lottery tickets have numbers or other symbols hidden from view by an overlying coating of latex material. The latex material is designed to be scraped from the ticket to reveal the underlying numbers or symbols. Often this is done with a coin or the player's fingernails. However, it has been found that flat, triangular devices, somewhat in the shape of mandolin picks, provide a rapid and efficient scrapping action, and at the same time, are readily carried in mating indentations 36 in the face 12.

In the form of the invention illustrated in FIGS. 1 through 3 of the drawings, the attractive appearance of the kit of the present invention is enhanced by the provision of rectangular protective cover members 37 and 38 formed to fit over the flattened rectangular case members 12 and 13 in covering relation thereto. Preferably, in order to permit changing of the protective cover members 37 and 38, they are snapped into place on the corresponding members 12 and 13 where raised ridges 39 engage in grooves 41 to removably hold the cover members 37 and 38 in place.

Lifting of items such as the marking device 33 and the scratching device 34 from the indentations in which they are nestled is facilitated by forming relieved depressions 42 adjacent to and communicating with the indentations for accomodating the fingertip of the user. The marking devices 33 are retained in their troughs against accidental dislodgment by inwardly projecting beads 43.

From the foregoing, it will be apparent that the kit for lottery playing paraphernalia of the present invention provides a compact, attractive and safe device for receiving, containing and storing lottery tickets, papers, marking devices, scratching devices and the like in a sturdy, integrally formed unitary case.

What is claimed is:

1. A kit for lottery playing paraphernalia comprising:

a clamshell case having a pair of generally flattened commensurate rectangular members formed for positioning face-to-face to provide a folio case adapted for containing equipment for playing a lottery;

a hinge joining said rectangular members along one side so that said members are swingable between a closed position with said members face-to-face and an open position with said faces of said members substantially coplanar;

said faces being provided with a plurality of indentations sized to receive and contain piles of rectangular papers and other objects used in playing the lottery;

said members being formed with clip fingers extending in overlying spaced relation to said indentations for releasably retaining papers therein against accidental dislodgment; and latch means on said rectangular members formed for releasably holding the latter in said closed position.

2. A kit for lottery playing paraphernalia as described in claim 1, and wherein said members are formed of stiffly resilient material having an integral thinned section between said rectangular members providing said hinge.

3. A kit for lottery playing paraphernalia as described in claim 2, and wherein said rectangular members and integral hinge are molded of polypropylene plastic.

4. A kit for lottery playing paraphernalia as described in claim 3, and wherein said latch means comprises a latching member integrally formed with one of said rectangular members on the side thereof opposite to said hinge, and a latch engaging member integrally formed with the other of said rectangular members on the side thereof opposite to said hinge and in confronting relation to said latching member.

5. A kit for lottery playing paraphernalia as described in claim 1, and wherein one of said rectangular members is formed with an elongated indentation in its face confronting the other of said rectangular members, and an elongated marking device is nestled in said indentation.

6. A kit for lottery playing paraphernalia as described in claim 1, and wherein rectangular protective cover members are formed to fit over said flattened case members in covering relation thereto, and interengaging snap means is provided on said case members and their associated cover members formed for releasably holding said cover members in place on said case members.

7. A kit for lottery playing paraphernalia as described in claim 1, wherein at least one said indentation is sized for receiving an elongated marking device used in lottery playing and wherein at least one said indentation is sized for receiving a scratching device used in lottery playing.

8. A kit for lottery playing paraphernalia, comprising:

first and second commensurate members each having an inner surface, an outer surface and perimeter edges, said inner and outer surfaces being contiguous to each other without space therebetween;

a protective cover member sized to fit a chosen one of said first and second members in covering relation thereto;

interengaging snap means, provided on the chosen member and on said protective cover member, for releasably holding the protective cover member in place on the chosen member;

said members being hingedly joined to each other along a perimeter edge such that in a closed position said members lie inner surface to inner surface thereby forming a clamshell folio case, and in an open position said members lie substantially coplanar;

an inner face of at least one member including at least one indentation sized to receive at least one piece of paper used in lottery playing; and a latch located on said first member for releasably retaining the second member when the clamshell folio case is in the closed position.

9. A kit for lottery playing paraphernalia as described in claim 8, wherein at least said one member including a said indentation further includes a finger extending from said inner surface in overlying spaced relation to said indentation, said finger releasably retaining an object used in playing the lottery within said indentation against accidental dislodgment.

10. A kit for lottery playing paraphernalia as described in claim 8, wherein at least one of said at least one indentation is sized for receiving an elongated marking device used in lottery playing.

11. A kit for lottery playing paraphernalia as described in claim 8, wherein at least one of said at least one indentation is sized for receiving a scratching device used in lottery playing.

12. A kit for lottery playing paraphernalia, comprising:

first and second commensurate members each having an inner surface, an outer surface and perimeter edges, said inner and outer surfaces being contiguous to each other without space therebetween;

said members being hingedly joined to each other along a perimeter edge such that is a closed position said members lie inner surface to inner surface thereby forming a clamshell folio case, and in an open position said members lie substantially coplanar;

a protective cover member sized to fit a chosen one of said first and second members in covering relation thereto;

interengaging snap means, provided on the chosen member and on said protective cover member, for releasably holding the protective cover member in place on the chosen member;

an inner face of at least one member including at least one indentation sized to receive an object used in lottery playing;

at least said one member including a said indentation further including a finger extending from said inner surface in overlying spaced relation to said indentation, said finger releasably retaining an object used in playing the lottery within said indentation against accidental dislodgement; and a latch located on said first member for releasably retaining the second member when the clamshell folio case is in the closed position.

13. A kit for lottery playing paraphernalia as described in claim 12, wherein at least one of said at least one indentation is sized for receiving at least one piece of paper used in lottery playing.

14. A kit for lottery playing paraphernalia as described in claim 12, wherein at least one of said at least one indentation is sized for receiving an elongated marking device used in lottery playing.

15. A kit for lottery playing paraphernalia as described in claim 12, wherein at least one of said at least one indentation is sized for receiving a scratching device used in lottery playing.

* * * * *